US006783342B2

(12) United States Patent
Norman et al.

(10) Patent No.: US 6,783,342 B2
(45) Date of Patent: Aug. 31, 2004

(54) METHOD AND APPARATUS FOR TIMING ROTORS IN A ROTARY LOBE PUMP

(75) Inventors: Drew Van Norman, Whitewater, WI (US); Curt Hagen, Delvan, WI (US)

(73) Assignee: United Dominion Industries, Inc., Charlotte, NC (US)

( * ) Notice: Subject to any disclaimer, the term of this patent is extended or adjusted under 35 U.S.C. 154(b) by 0 days.

(21) Appl. No.: 10/244,538

(22) Filed: Sep. 17, 2002

(65) Prior Publication Data

US 2003/0059330 A1 Mar. 27, 2003

Related U.S. Application Data

(60) Provisional application No. 60/324,525, filed on Sep. 26, 2001.

(51) Int. Cl.[7] ..... F04C 21/18; F04C 15/00

(52) U.S. Cl. ..... 418/206.1; 418/206.2; 418/206.6; 403/370; 403/371

(58) Field of Search ..... 418/1, 206.1, 206.2, 418/206.6; 403/359.6, 365–368, 370, 371

(56) References Cited

U.S. PATENT DOCUMENTS

| | | | | | |
|---|---|---|---|---|---|
| 1,472,565 | A | * | 10/1923 | Manning | 403/370 |
| 4,453,901 | A | * | 6/1984 | Zimmerly | 418/206.1 |
| 5,013,227 | A | * | 5/1991 | Guittet et al. | 418/206.1 |
| 5,052,842 | A | * | 10/1991 | Janatka | 403/366 |
| 5,154,595 | A | * | 10/1992 | Takeda | 418/201.1 |
| 5,174,680 | A | * | 12/1992 | Nakamura et al. | 403/370 |
| 5,308,183 | A | * | 5/1994 | Stegeman et al. | 403/371 |
| 6,341,951 | B1 | * | 1/2002 | Chen et al. | 418/201.1 |

* cited by examiner

*Primary Examiner*—John J. Vrablik
(74) *Attorney, Agent, or Firm*—Baker & Hostetler LLP

(57) ABSTRACT

A rotary lobe pump includes two geared-together, counter-rotating shafts, to which are affixed rotors with interdigital lobes. Adjustment of the angular relationship of the rotors uses a clamping device within each rotor. The clamping device consists of a tapered, slotted bushing that is forced between a mating taper on the rotor and a locking device on the shaft by means of a flanged fastener mated to each pump shaft's threads.

17 Claims, 6 Drawing Sheets

METHOD AND APPARATUS FOR TIMING ROTORS IN A ROTARY LOBE PUMP

PRIORITY OF INVENTION

The application claims priority to U.S. Provisional Patent Application Ser. No. 60/324,525 filed Sep. 26, 2001, the disclosure of which is hereby incorporated by reference.

FIELD OF THE INVENTION

The present invention relates generally to rotary lobe pumps. More particularly, the present invention relates to rotary lobe pump timing adjustment.

BACKGROUND OF THE INVENTION

Rotary lobe pumps are used in industry for positive-displacement pumping of foodstuffs, pharmaceuticals, and other materials requiring avoidance of cross-contamination, freedom from chemical interaction with a wide range of substances, and good mechanical strength. Dimensional tolerances in all parts of the pumps, especially in the vicinity of the working lobes, are extremely close. Tight, uniform tolerances between the lobes of the two rotors and between the rotor tips and the walls of the pumping chamber are desirable because insufficient clearance results in binding and wear, while excessive clearance reduces pumping efficiency.

The requirements for strength, low contamination, and inertness lead to the use of 316 corrosion resistant ("stainless") steel (CRS), special alloys, or the like for parts exposed to the materials being pumped. Parts fabricated of such alloys can be sterilized and satisfy structural and producibility needs.

The two rotors comprising the materials-handling part of rotary lobe pumps are geared together with tight-tolerance spur gears, helical gears, or another low-lash, positive mesh design. Such pumps use rather long drive shafts between the materials-handling end and the drive end of the pump, ensuring dimensional stability—the long intermediate region housing the bearings holds the shafts rigidly parallel. Typical designs also provide a degree of thermal isolation, as well as physical separation between the materials-handling end and the drive end.

In food and drug applications, Federal and state regulations call for disassembly for cleanliness inspections and operational tests on the order of once per day to once per month for pumps in continuous use. Standard procedures in the user industries call for testing in place (removal of front cover, visual exam, shim test, and possible swab for culture) preceded and followed by a cleaning flush. If the shim test fails, the typical previous design of pump must be removed from the system, taken to a shop, and overhauled.

For previous designs, the rotors are keyed or otherwise rigidly attached to their shafts, while friction clamping on the gears at the drive end of the shafts fixes the rotational relationship, termed here the timing, between the shafts. For such designs, timing adjustment requires disassembly of piping and demounting of the pump, then removing access covers on the drive end for adjustment and on the materials-handling end for measurement. The adjustable gear clamp must be loosened, shims set in place between the rotor lobes, the assembly tightened again, and the workmanship checked by moving the shims to critical locations and rotating the shafts. Finally, the entire assembly must be lubricated, sterilized, and remounted to the machine from which it was removed.

Materials being pumped can contain foreign or oversized particles that migrate to the points of least clearance. Such obstructions can cause transient torque spikes to be applied between the two rotors or between the rotors and their driving mechanisms. This in turn can exceed the friction limits of the clamping devices, resulting in alignment shift. Unless the shift causes noticeable anomalies—noise, slowing of drive motors, and the like—such errors ordinarily remain in the system until the next periodic servicing event.

Accordingly it is desirable to provide a rotary lobe pump that simplifies maintenance by leaving the drive end of the pump sealed during routine timing adjustment.

SUMMARY OF THE INVENTION

It is therefore a feature and advantage of the present invention to provide the capability to relocate the adjustment provision of rotary lobe pump timing to the materials-handling end of the pump.

It is another feature and advantage of the present invention to provide continuously adjustable timing through use of slotted, tapered bushings.

It is another feature and advantage of the present invention to permit routine maintenance with unimpaired precision while the pump remains in place on the machine of which it forms a part.

It is another feature and advantage of the present invention to have the ability to leave gear mesh at the drive end of the pump intact during pump lobe timing adjustment.

The above and other features and advantages are achieved by a novel method of fixing lobe pump rotors, as herein disclosed. In accordance with one embodiment of the present invention, a pump for pumping material comprises a first shaft, a first tapered bushing, sized to fit the first shaft, a first rotor, fitting the first shaft, with an internal tapered region fitted to the first tapered bushing, and a first threaded fastening device that urges the first rotor and the first shaft into frictional contact with the first bushing.

In another aspect, the invention provides apparatus for setting timing of rotors in a rotary lobe pump, comprising a tapered bushing; a rotor configured to mesh with an identical rotor in overlapping rotational paths; a shaft configured to accept the rotor; and means, such as a threaded fastening device, for securing the bushing, rotor, and shaft together.

In another aspect, the invention provides a method for providing adjustable timing of lobe pump rotors, comprising the steps of equipping each rotor with a tapered inner mating surface; equipping each rotor with a flat rear mating surface; driving each rotor with a drive shaft having a shoulder that mates to a flat rear mating surface of the rotor; locating a tapered bushing between at least one of the shafts and its respective rotor; and applying compression normal to the inner mating surface of the rotor to secure the bushing, rotor, and shaft together.

There have thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

The invention provides a novel rotor attachment technique that can retain full mechanical strength in all parts of the pump, provide unimpaired ability to adjust spacing between the rotors, and leave the drive end of the pump untouched during timing adjustment. Embodiments of the invention accomplish this by keying or otherwise rigidly attaching the gears to the drive ends of the two shafts and using tapered-bushing clamping of the rotors onto their respective shafts.

A preferred embodiment of the present invention provides a slotted, tapered busing mated to a tapered hole that comprises the center hole in a lobed rotor. These two items are placed on a shaft that has a shoulder against which the rotor rests; a keying feature, such as a flat, that aligns the busing; and a threaded end 53 beyond the keying feature. When the bushing is drawn into the tapered hole in the rotor by a nut riding on the treaded portion of the shaft, the rotor is stopped by the shaft shoulder, and the bushing applies enough force outward to the rotor and inward to the shaft to fix the assembly rigidly.

Two such shaft-and-rotor assemblies, counter-rotating, geared together at a 1:1 ratio, with the two rotors turning in an elongated cylindrical chamber, comprise a lobed rotor pump. The number of lobes on each rotor is at least one, and may be any number for which suitable geometry and manufacturing techniques may be established. The pump receives feed of fluid or fluidized material through an inlet at the center of elongation of the chamber, and sweeps alternating portions of the material around each half of the perimeter of the combined chamber, expelling the recombined material through an opening opposite that on the inlet side. Adjustment of relative rotor angular position to maintain the dimensional tolerances required for successful use of the pump is accomplished by unscrewing the locking nut on one of the rotor shafts, which relaxes the corresponding tapered bushing and releases the rotor being adjusted. Turning the rotor as required permits restoration of nominal dimensions; retightening the nut locks the adjustment in place.

Figure 1:
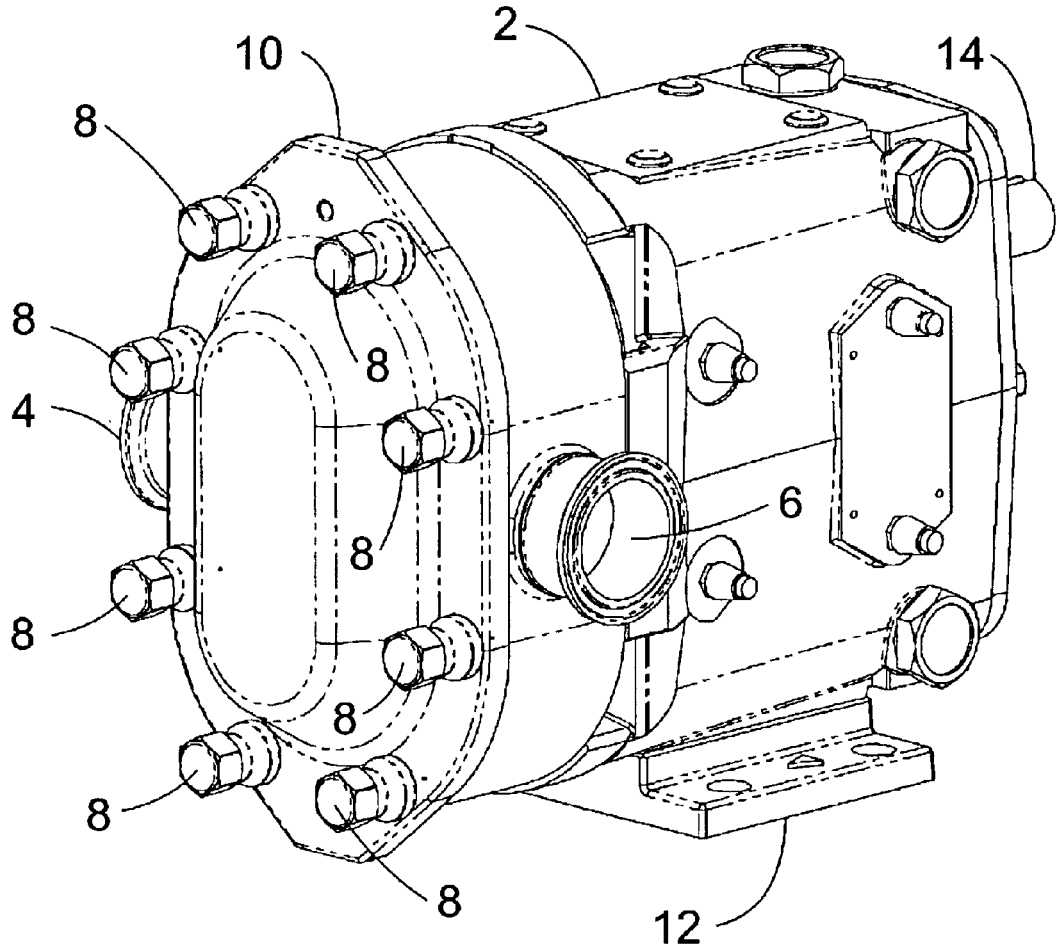
FIG. 1 provides a perspective view illustrating the overall appearance of a preferred embodiment of the present invention.

In FIG. 1, an external view illustrates a preferred embodiment of the present inventive apparatus and method. A pump assembly includes a housing 2, an inlet port 4, an outlet port 6, a set of locking nuts 8 that hold a cover 10 in place, a set of mounting lugs 12, and a drive shaft 14.

Figure 2:
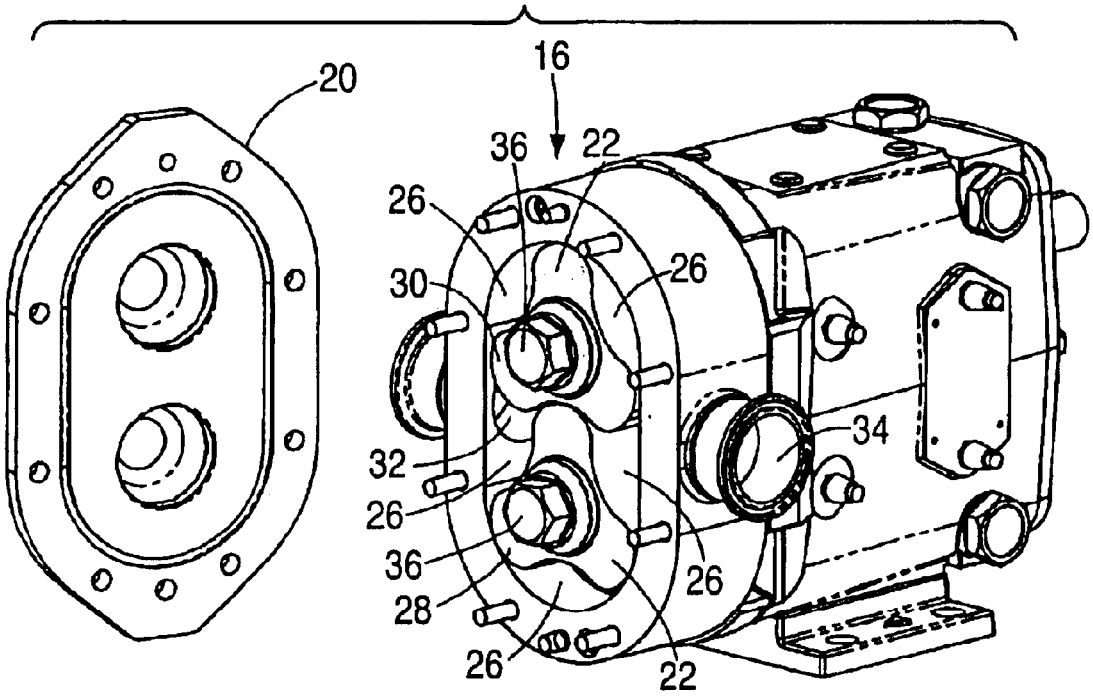
FIG. 2 provides a partially disassembled view illustrating the relationship between the rotors, housing, and ports of a preferred embodiment of the present invention.

FIG. 2, which is similar to FIG. 1, but with the locking nuts and cover 20 removed, shows the inside of a pump chamber 16 of a preferred embodiment. Two rotors are retained by two nuts 36. Representative swept pockets 26 within the pump for as the rotor lobes 28 and 30 on the tow rotors move apart from an inlet port 32. Each pocket 26 moves around the periphery of the chamber, and collapses as it reaches an outlet port 34.

Figure 3:
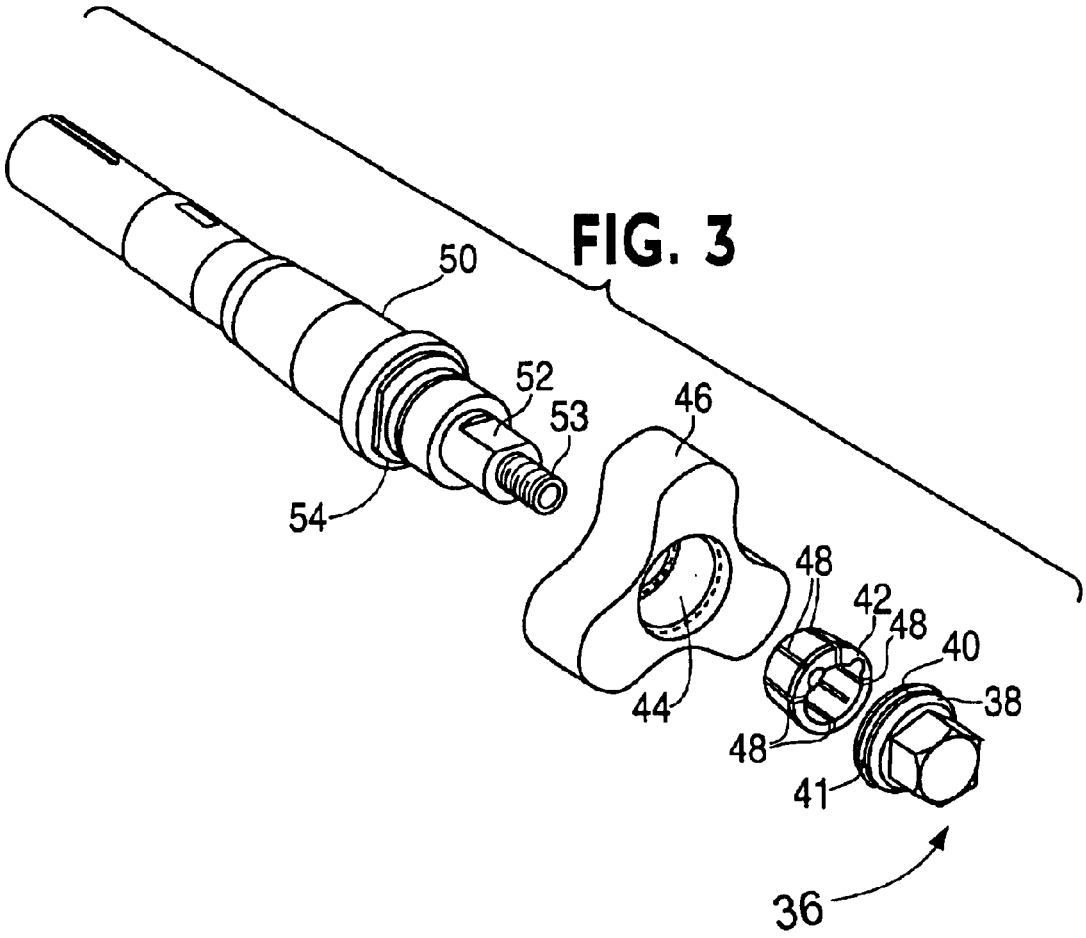
FIG. 3 provides an exploded view of a nut, a bushing, a rotor, and a shaft to illustrate the way in which the elements at the materials-handling end of a preferred embodiment of the present invention go together.

An exploded view of a rotor-and-shaft assembly as illustrated in FIG. 3. Here, a nut 36 may be seen to have an integral flange 38 and an O-ring groove 40 having an O-ring disposed therein that provides a seal between the nuts 36 and the lobes 28, 30. Flange 38 presses a tapered bushing 42 into a mating tapered hole 44 in a rotor 46. A set of slots 48 in the bushing 42 allow the bushing 42 to collapse without permanent distortion against a shaft 50 when pressed into tapered hole 44 by the flange 38 on the nut 36. A flat 52 on the shaft 50 serves as a keying device for the bushing 42. A shoulder 54 on the shaft 50 stops the rotor 46, immobilizing it and allowing the compression process to proceed. Once the nut 36, bushing 42, and rotor 46 are fully drawn together on shaft 50, they form a rigid assembly. Unscrewing the nut 36 allows the bushing 42 to back out of intimate contact with the rotor 46 and the shaft 50, permitting readjustment of the rotational orientation of the rotor 46.

Figure 5:
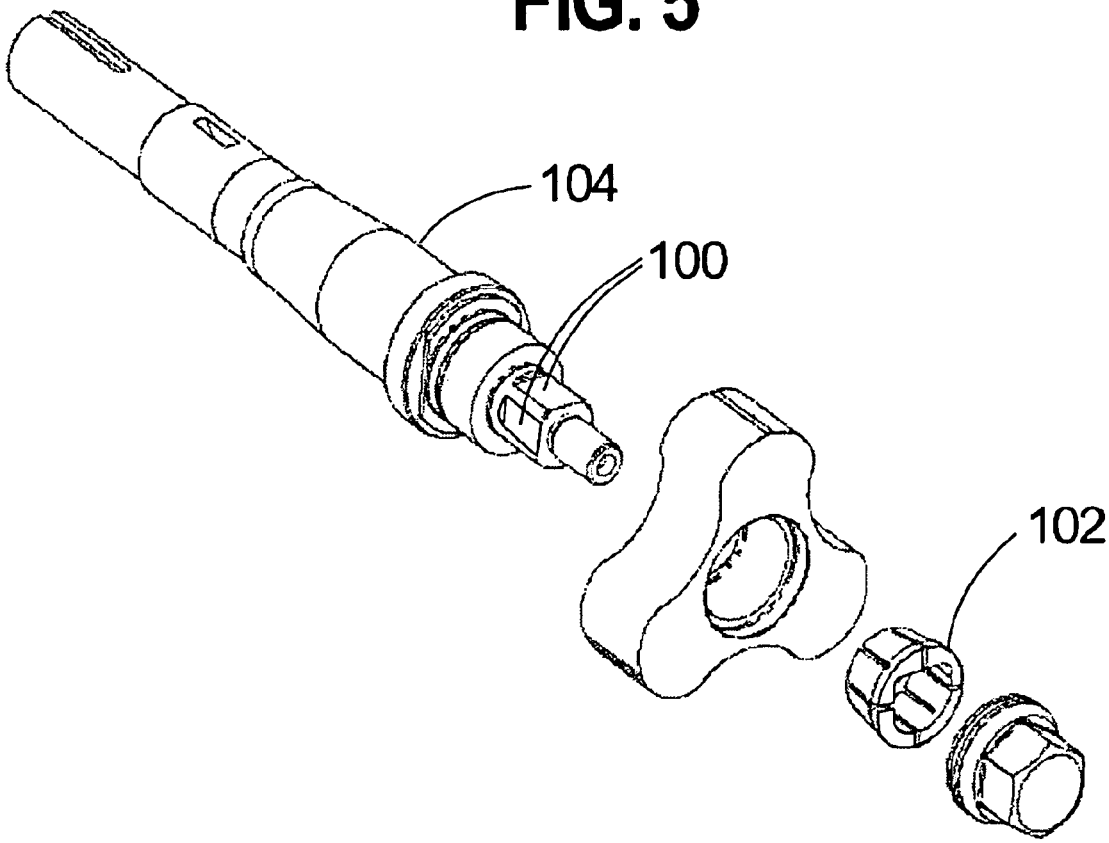
FIG. 5 provides an exploded view of a nut, a bushing, a rotor, and a shaft to illustrate a bushing and rotor assembly with more than one flat serving as a keying feature.
Figure 6:
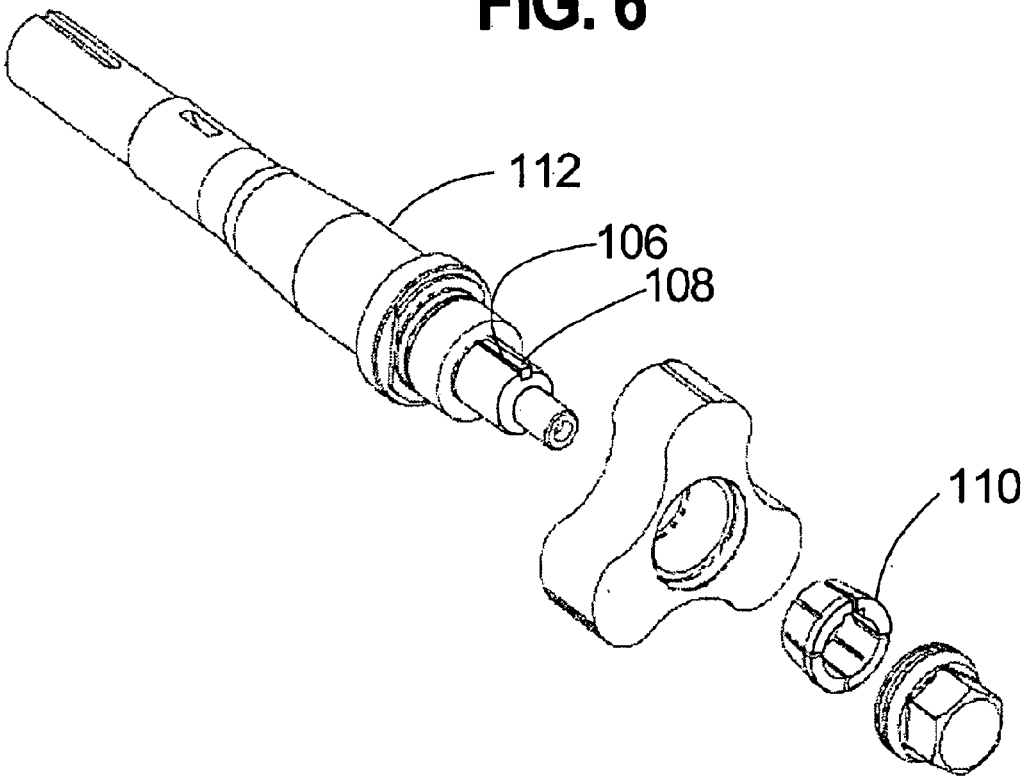
FIG. 6 provides an exploded view of a nut, a bushing, a rotor, and a shaft to illustrate a bushing and rotor assembly with a keyway and key serving as a keying feature.

As shown in FIG. 5, a multiple-flat 100 configuration on a tapered bushing 102 and a mating shaft 104 can serve as an anti-rotation device in place of the single-flat 52 configuration of FIG. 3. Similarly, as shown in FIG. 6, a keyway 106 and key 108 configuration on a tapered bushing 110 and a mating shaft 112 can be used as an anti-rotation device in place of the single-flat 52 configuration of FIG. 3.

Figure 4:
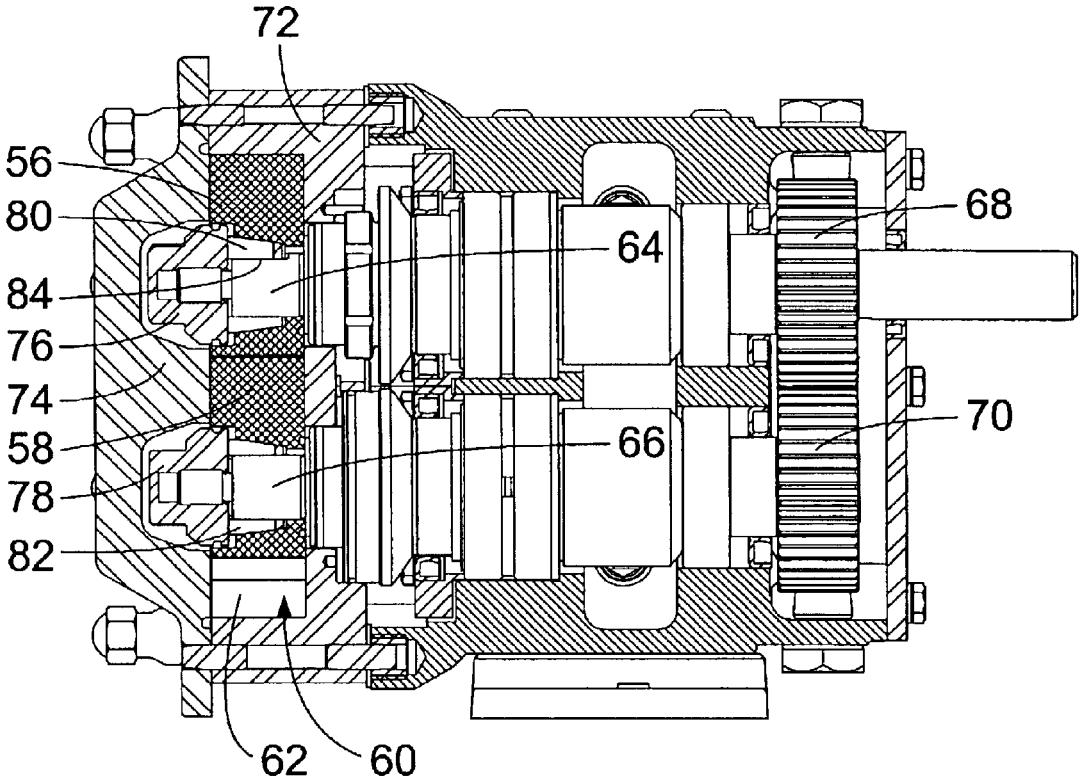
FIG. 4 provides a section view along the axis of the parallel drive shafts showing the relationship between the components of a preferred embodiment of the present invention.

A cross section of a complete pump is shown in FIG. 4. Here, the first rotor 56 and second rotor 58, oriented as shown in FIG. 2, are seen to occupy all of the volume of a chamber 60 except a swept pocket 62, which is another view of the bottom swept pocket 26 in FIG. 2. A first drive shaft 64 and a second drive shaft 66 carry their respective rotors 56 and 58. A first spur gear 68 and a second spur gear 70 mesh to cause rotors 56 and 58 to rotate in opposite directions. A housing front section 72 and a cover 74 define the chamber. A first nut 76 and a second nut 78 retain first rotor 56 and second rotor 58, respectively, urging a first tapered bushing 80 and a second tapered bushing 82 into contact with their respective rotors 56 and 58, and shafts 64 and 66. The first drive shaft 64 and first tapered bushing 80 may be seen to be sectioned through a flat 84 on shaft 64, illustrating the locking feature.

The lobe and chamber geometry shown is an example of that used on large numbers of pumps in manufacturing, although it is not the only shape capable of pumping with good efficiency. Alternate lobe geometries may be used.

Referring to FIG. 3, the number of slots 48 cut in the tapered bushing 42 is for example eight: four closed at the nut end of the bushing, three closed at the opposite end, and one cut all the way through, located opposite the flat. This number is preferable but other numbers of slots may be used. Likewise, slot width and web depth may be different from what is illustrated.

Since pump shaft diameter is defined by torque loading and safety factors, bushing size is preferably selected within limits imposed by those factors.

Bushing taper angle can affect characteristics of the finished design. Dimensional choices depend on tradeoffs between several properties of the materials comprising the pump and the operational characteristics being pursued. Shallower taper angle—closer to cylindrical—causes tighter clamping with less applied nut torque, but can lead to binding during disassembly if excessive. Different surface finishes produce similar tradeoffs. The taper angle shown, 8 degrees, a surface finish of 32 Ra, and the material, 316 CRS or other appropriate alloy, have been determined by engineering experience and test to produce satisfactory finished products suitable for use in some heavy production environments.

With the present invention, each routine disassembly for inspection and cleaning permits a simple adjustment at need that restores the rotor-to-rotor clearances to factory specifications without demounting the pump. By encouraging and facilitating restoration of original-specification timing during servicing procedures mandated by regulation, the present invention permits reduction in the likelihood of pump failure and of production interruption.

For the present invention, timing adjustment can be performed by removal of the materials-handling-side cover, loosening of the lock nut on one rotor, insertion of spacing shims between the rotors, tightening, final verification using the shims at various points as the shafts are rotated, and replacement of the cover.

With the present invention, ability to establish timing accuracy, stability in operation (a function of the rigidity of the structure), simplicity of inspection, and ability to hold timing settings over long periods of heavy use can, at the least, remain as satisfactory as in previous designs. Performance of major repairs proceeds essentially as before, but routine adjustment appreciably simplified.

The many features and advantages of the invention are apparent from the detailed specification; thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described. Accordingly, all suitable modifications and equivalents may be resorted to, that fall within the scope of the invention.

What is claimed is:

1. A rotary lobe pump for pumping material, comprising:

a pump chamber;

a first shaft with a threaded section;

a first tapered bushing, sized to fit said first shaft;

a first lobed rotor, fitting said first shaft, with an internal tapered region fitted to said first tapered bushing, wherein said first rotor is installed in said pump chamber;

a first threaded fastening device, mating with the threaded section on said first shaft, that urges said first rotor and said first shaft into frictional contact with said first bushing; and a seal between said first threaded fastening device and said first lobed rotor that seals said tapered bushing from said pump chamber.

2. The pump of claim 1, further comprising:

a first shoulder on said first shaft, positioned to provide a stop face against which said first rotor rests when said first threaded fastening device urges said first tapered bushing between said first rotor and said first shaft.

3. The pump of claim 1, further comprising:

a first plurality of flats on said first shaft, positioned to engage said first tapered bushing and prevent rotation of said first tapered bushing relative to said first shaft.

4. The rotary lobe pump of claim 1, further comprising:

a second shaft with a threaded section; and a second lobed rotor fitting said second shaft.

5. The rotary lobe pump of claim 4, further comprising:

a second tapered bushing sized to fit said second shaft, wherein said second rotor has an internal tapered region fitted to said second tapered bushing; and a second threaded fastening device that urges said second rotor and said second shaft into frictional contact with said second bushing a seal between said second threaded fastening device and said second lobed rotor that seals said second tapered bushing from said pump chamber.

6. The pump of claim 4, further comprising:

a second shoulder on said second shaft, positioned to provide a stop face against which said second rotor rests when said second threaded fastening device urges said second tapered bushing between said second rotor and said second shaft.

7. The pump of claim 4, further comprising:

a first gear, sized to fit to said first shaft.

8. The pump of claim 7, further comprising:

a second gear, sized to fit said second shaft, configured to mesh with said first gear to cause said first and second shafts to rotate in opposite directions at the same rate.

9. A pump for pumping material, comprising:

a first shaft;

a first tapered bushing, sized to fit said first shaft;

a first rotor, fitting said first shaft, with an internal tapered region fitted to said first tapered bushing;

a first threaded fastening device that urges said first rotor and said first shaft into frictional contact with said first bushing; and a first flat on said first shaft, positioned to engage said first tapered bushing and prevent rotation of said first tapered bushing relative to said first shaft.

10. A pump for pumping material, comprising:

a first shaft;

a first tapered bushing, sized to fit said first shaft;

a first rotor, fitting said first shaft, with an internal tapered region fitted to said first tapered bushing;

a first threaded fastening device that urges said first rotor and said first shaft into frictional contact with said first bushing; and a first keyway and key assembly on said first shaft, positioned to engage said first tapered bushing and prevent rotation of said first tapered bushing relative to said first shaft.

11. A pump for pumping material, comprising:

a first shaft;

a first tapered bushing, sized to fit said first shaft;

a first rotor, fitting said first shaft, with an internal tapered region fitted to said first tapered bushing;

a first threaded fastening device that urges said first rotor and said first shaft into frictional contact with said first bushing;

a second shaft with a threaded section;

a second lobed rotor fitting said second shaft; and a second flat on said second shaft, positioned to engage a second tapered bushing and prevent rotation of said second tapered bushing relative to said second shaft.

12. A pump for pumping material, comprising:

a first shaft;

a first tapered bushing, sized to fit said first shaft;

a first rotor, fitting said first shaft, with an internal tapered region fitted to said first tapered bushing;

a first threaded fastening device that urges said first rotor and said first shaft into frictional contact with said first bushing;

a second shaft with a threaded section;

a second lobed rotor fitting said second shaft; and a second plurality of flats on said second shaft, positioned to engage second tapered bushing and prevent rotation of said second tapered bushing relative to said second shaft.

13. A pump for pumping material, comprising:

a first shaft;

a first tapered bushing, sized to fit said first shaft;

a first rotor, fitting said first shaft, with an internal tapered region fitted to said first tapered bushing;

a first threaded fastening device that urges said first rotor and said first shaft into frictional contact with said first bushing;

a second shaft with a threaded section;

a second lobed rotor fitting said second shaft; and a second keyway and key assembly on said second shaft, positioned to engage second tapered bushing and prevent rotation of said second tapered bushing relative to said second shaft.

14. A pump for pumping material, comprising:

a first shaft;

a first tapered bushing, sized to fit said first shaft;

a first rotor, fitting said first shaft, with an internal tapered region fitted to said first tapered bushing;

a first threaded fastening device that urges said first rotor and said first shaft into frictional contact with said first bushing;

a second shaft with a threaded section; and a second lobed rotor fitting said second shaft, wherein said second lobed rotor is keyed to said second shaft, to rotate therewith.

15. An apparatus for setting timing of a first lobed rotor configured to mesh with an identical second lobed rotor in overlapping rotational paths in a rotary lobe pump, comprising:

a first tapered bushing;

a first shaft configured to accept the first lobed rotor, and having a threaded section;

a first threaded fasting device mating with the threaded section on the shaft and securing said bushing, the first lobed rotor, and said shaft to rotate together; and a seal that seals between said first threaded fastening device and said first lobed rotor.

16. An apparatus for setting timing of a first lobed rotor configured to mesh with an identical second lobed rotor in overlapping rotational paths in a rotary lobe pump, comprising:

a pump chamber;

a first tapered bushing;

a first shaft configured to accept the first lobed rotor, and having a threaded section;

means for securing said first bushing, the first lobed rotor, and said first shaft to rotate together; and means for sealing between said means for securing said first bushing and said first lobed rotor that seals said tapered bushing from said pump chamber.

17. A method for providing adjustable timing of lobe pump rotors, comprising the steps of:

providing a pump chamber;

equipping each rotor with a tapered inner mating surface;

equipping each rotor with a rear stopping surface;

driving each rotor with a drive shaft having a shoulder that mates to a rear stopping surface of the rotor;

locating a tapered bushing between at least one of the shafts and its respective rotor;

applying compression normal to the inner mating surface of the rotor to secure the bushing, rotor, and shaft together; and sealing between the rear stopping surface and each of the lobe pump of the lobe pump rotors so that the tapered bushing is sealed from the pump chamber.

* * * * *